US011567446B2

(12) United States Patent
Fukamachi et al.

(10) Patent No.: US 11,567,446 B2
(45) Date of Patent: Jan. 31, 2023

(54) PROCESS CARTRIDGE CONFIGURED OF DEVELOPING CARTRIDGE INCLUDING ELECTRICAL CONTACT SURFACE, AND DRUM CARTRIDGE INCLUDING ELECTRICAL CONTACT SURFACE AND LOCK LEVER

(71) Applicant: BROTHER KOGYO KABUSHIKI KAISHA, Nagoya (JP)

(72) Inventors: Yasuo Fukamachi, Nagoya (JP); Shinya Kusuda, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/581,487

(22) Filed: Jan. 21, 2022

(65) Prior Publication Data

US 2022/0283537 A1 Sep. 8, 2022

(30) Foreign Application Priority Data

Mar. 4, 2021 (JP) ..... JP2021-034120

(51) Int. Cl.
*G03G 21/18* (2006.01)

(52) U.S. Cl.
CPC ..... *G03G 21/1814* (2013.01); *G03G 21/1871* (2013.01)

(58) Field of Classification Search
CPC ..... G03G 21/1814; G03G 21/1825; G03G 21/1867; G03G 21/1871; G03G 21/1878; G03G 21/1885
See application file for complete search history.

(56) References Cited

U.S. PATENT DOCUMENTS

2008/0226341 A1* 9/2008 Mase ..... G03G 21/1889 399/119
2017/0184998 A1 6/2017 Itabashi
2018/0095420 A1* 4/2018 Abe ..... G03G 21/1867
2019/0391529 A1 12/2019 Abe et al.

FOREIGN PATENT DOCUMENTS

JP 2017-116826 A 6/2017
JP 2018-146829 A 9/2018
JP 2019-174624 A 10/2019

* cited by examiner

*Primary Examiner* — Hoang X Ngo
(74) *Attorney, Agent, or Firm* — Merchant & Gould P.C.

(57) ABSTRACT

A process cartridge includes a developing cartridge and a drum cartridge. The developing cartridge includes: a casing; a developing roller rotatable about a developing axis extending in a first direction; and a development-side IC chip having a development-side electrical contact surface. The drum cartridge includes: a drum frame; a photosensitive drum rotatable about a drum axis extending in the first direction; a drum-side IC chip having a drum-side electrical contact surface; and a lock lever configured to lock the developing cartridge to the drum frame. The development-side electrical contact surface and the drum-side electrical contact surface are positioned opposite to the lock lever with respect to the casing in the first direction in a state where the developing cartridge is attached to the drum frame.

20 Claims, 9 Drawing Sheets

PROCESS CARTRIDGE CONFIGURED OF DEVELOPING CARTRIDGE INCLUDING ELECTRICAL CONTACT SURFACE, AND DRUM CARTRIDGE INCLUDING ELECTRICAL CONTACT SURFACE AND LOCK LEVER

CROSS REFERENCE TO RELATED APPLICATIONS

This application claims priority from Japanese Patent Application No. 2021-034120 filed Mar. 4, 2021. The entire content of the priority application is incorporated herein by reference.

BACKGROUND

There has been known a process cartridge including a developing cartridge and a drum cartridge. The developing cartridge includes an IC chip having an electrical contact surface, a developing roller rotatable about a developing axis extending in a first direction, and a casing configured to accommodate therein toner. The drum cartridge includes an IC chip having an electrical contact surface, a photosensitive drum rotatable about a drum axis extending in the first direction, a drum frame, and a lock lever configured to lock the developing cartridge to the drum frame.

The electrical contact surface of the developing cartridge is positioned at one end portion of the casing in the first direction. The electrical contact surface of the drum cartridge is positioned at one end portion or another end portion of the drum frame in the first direction. Further, the lock lever is positioned at the one end portion of the drum frame in the first direction.

SUMMARY

In the above-described conventional process cartridge, in a case where the electrical contact surface of the drum cartridge is positioned at the other end portion of the drum frame in the first direction, the electrical contact surface of the developing cartridge and the lock lever of the drum cartridge are positioned opposite to the electrical contact surface of the drum cartridge with respect to the casing of the developing cartridge in the first direction in an attached state of the developing cartridge to the drum frame. Accordingly, a user's hand may touch the electrical contact surface of the developing cartridge when the user operates the lock lever, which may result in contamination of the electrical contact surface of the developing cartridge.

In view of the foregoing, it is an object of the disclosure to provide a structure to suppress contamination of the electrical contact surface of the developing cartridge or of the drum cartridge due to accidental contact of the user's hand with the electrical contact surface when the user operates the lock lever.

In order to attain the above and other object, according to one aspect, the present disclosure provides a process cartridge including a developing cartridge and a drum cartridge. The developing cartridge includes: a casing configured to accommodate therein toner; a developing roller rotatable about a developing axis extending in a first direction; and a development-side IC chip having a development-side electrical contact surface. The drum cartridge includes: a drum frame to which the developing cartridge is detachably attachable; a photosensitive drum rotatable about a drum axis extending in the first direction; a drum-side IC chip having a drum-side electrical contact surface; and a lock lever configured to lock the developing cartridge to the drum frame. The development-side electrical contact surface and the drum-side electrical contact surface are positioned opposite to the lock lever with respect to the casing in the first direction in a state where the developing cartridge is attached to the drum frame.

According to the above-described structure, the electrical contact surface of the developing cartridge and the electrical contact surface of the drum cartridge are positioned opposite to the lock lever with respect to the casing of the developing cartridge in the first direction. With this structure, when the user operates the lock lever, contact by the user's hand on the electrical contact surface of the developing cartridge or the electrical contact surface of the drum cartridge can be suppressed. Accordingly, this structure can restrain each electrical contact surface from getting contaminated by the user's hand.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, one embodiment of the present disclosure will be described with reference to the accompanying drawings.

Figure 1:
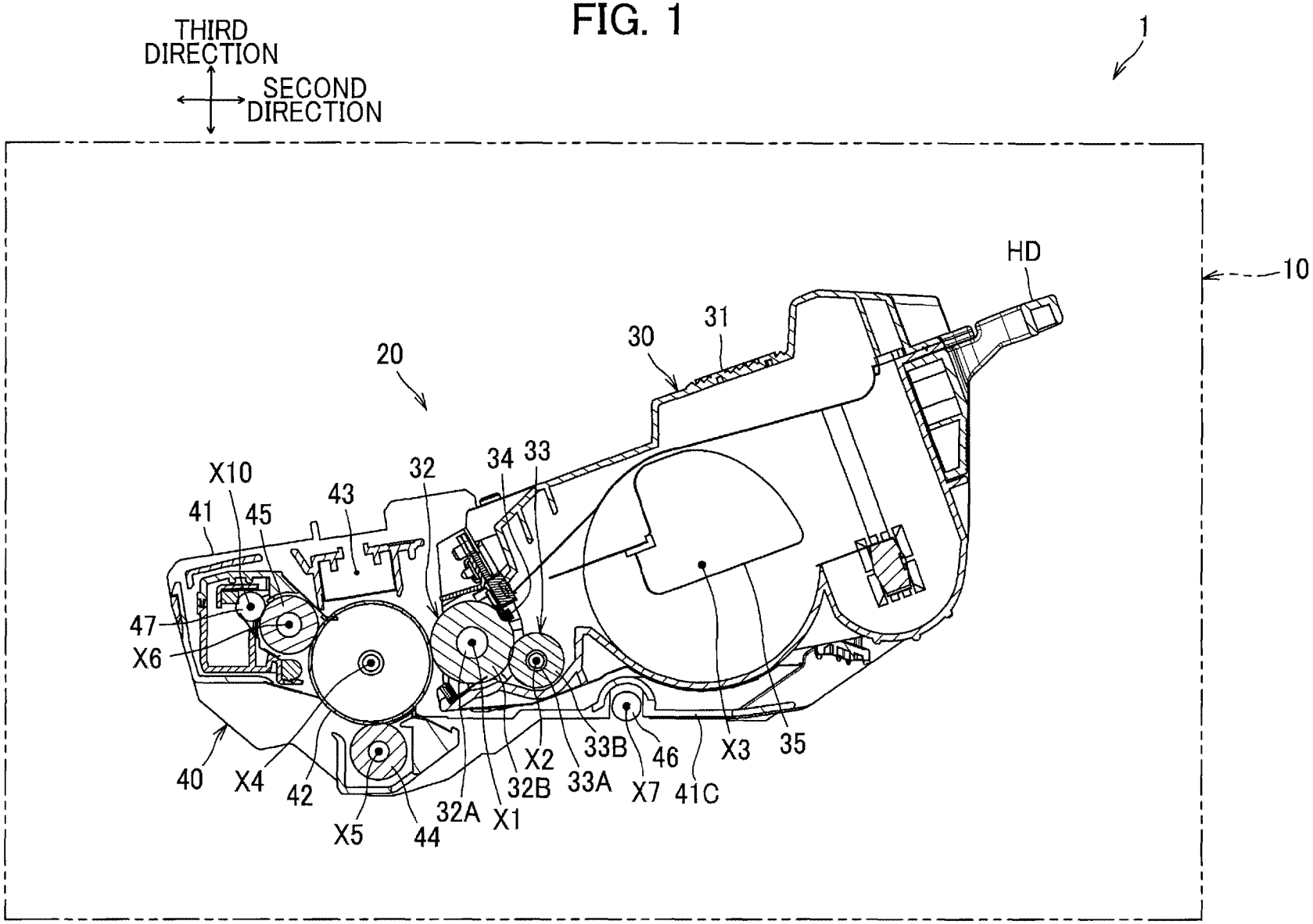
FIG. 1 is a cross-sectional view illustrating a structure of a process cartridge.

As illustrated in FIG. 1, an image-forming apparatus 1 includes a housing 10 and a process cartridge 20. Incidentally, for the sake of convenience, the housing 10 is depicted in a smaller size than an actual size thereof in FIG. 1.

The process cartridge 20 is attachable to and detachable from the housing 10. The process cartridge 20 includes a developing cartridge 30 and a drum cartridge 40. The developing cartridge 30 is attachable to and detachable from a drum frame 41 (described later) of the drum cartridge 40.

Figure 2:
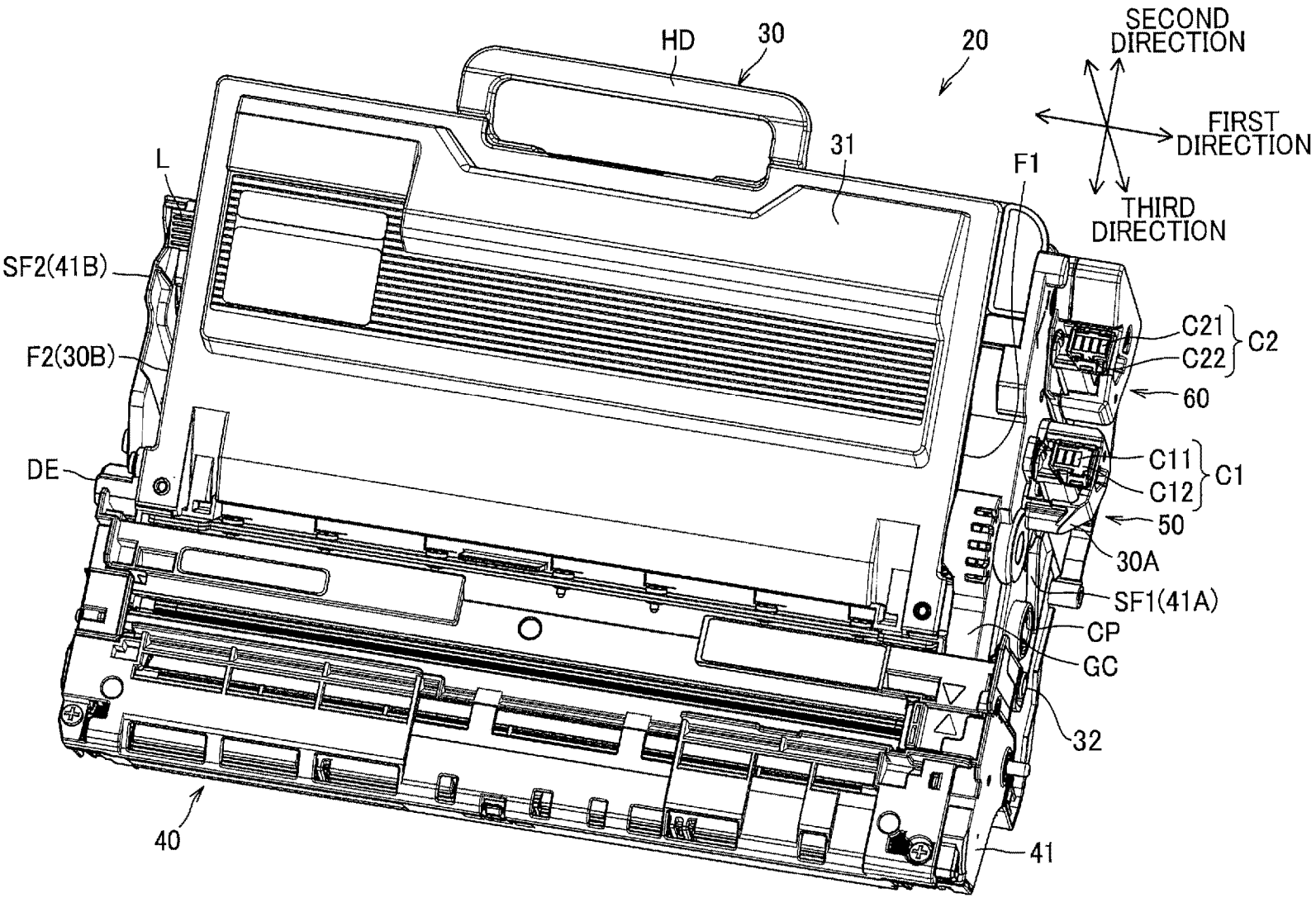
FIG. 2 is a perspective view of the process cartridge.

The developing cartridge 30 includes a casing 31, a developing roller 32, a supply roller 33, a layer thickness regulation blade 34, an agitator 35, a handle HD, a developing coupling CP (see FIG. 2), and a developing electrode DE (see FIG. 2).

The casing 31 is configured to accommodate therein toner. The casing 31 has a first outer surface F1 and a second outer surface F2 positioned away from the first outer surface F1 in a first direction.

The developing roller 32 is configured to supply toner to a photosensitive drum 42 (described later) of the drum cartridge 40. The developing roller 32 is rotatable about a developing axis X1 extending in the first direction. The developing roller 32 is positioned at one end portion of the casing 31 in a second direction crossing the first direction. Preferably, the second direction is perpendicular to the first direction. In the present embodiment, the second direction is perpendicular to the first direction. Further, in the present embodiment, the second direction is a direction in which a development-side electrical contact surface C11 (described later) of the developing cartridge 30 extends.

Further, in the present embodiment, a direction perpendicular to the first direction and the second direction will be referred to as a third direction. Further, in the present embodiment, the third direction is a direction perpendicular to the development-side electrical contact surface C11. Further, in the present embodiment, the third direction is parallel to an up-down direction in a state where the process cartridge 20 is attached to the housing 10. Incidentally, the third direction may be any direction as long as the third direction crosses the first direction and the second direction.

The developing roller 32 is positioned at one end portion of the casing 31 in the second direction. The developing roller 32 includes a developing roller shaft 32A, and a roller body 32B. The developing roller shaft 32A has a solid cylindrical shape. The roller body 32B has a hollow cylindrical shape. The developing roller shaft 32A is made from metal. The developing roller shaft 32A extends in the first direction. The roller body 32B is made from rubber. The roller body 32B is disposed over a part of the developing roller shaft 32A.

The handle HD is a part configured to be gripped by a user. The handle HD has a U-shape, as illustrated in FIG. 2. The handle HD is positioned at another end portion of the casing 31 in the second direction.

The supply roller 33 is configured to supply toner to the developing roller 32. The supply roller 33 is rotatable about a supply axis X2 extending in the first direction. The supply roller 33 is positioned between the developing roller 32 and the handle HD in the second direction. Specifically, the supply axis X2 is positioned between the developing axis X1 and the handle HD in the second direction.

The supply roller 33 includes a supply roller shaft 33A of a solid cylindrical shape, and a roller body 33B of a hollow cylindrical shape. The supply roller shaft 33A is made from metal. The supply roller shaft 33A extends in the first direction. The roller body 33B is made from rubber. The roller body 33B is disposed over a part of the supply roller shaft 33A. The roller body 33B is in contact with the roller body 32B of the developing roller 32.

The layer thickness regulation blade 34 is configured to regulate a thickness of a toner layer carried on the developing roller 32. The layer thickness regulation blade 34 is in contact with the roller body 33B of the developing roller 32.

The agitator 35 is configured to agitate the toner accommodated in the casing 31. The agitator 35 is also configured to supply the toner to the supply roller 33. The agitator 35 is rotatable about an agitator axis X3 extending in the first direction.

Figure 6A:
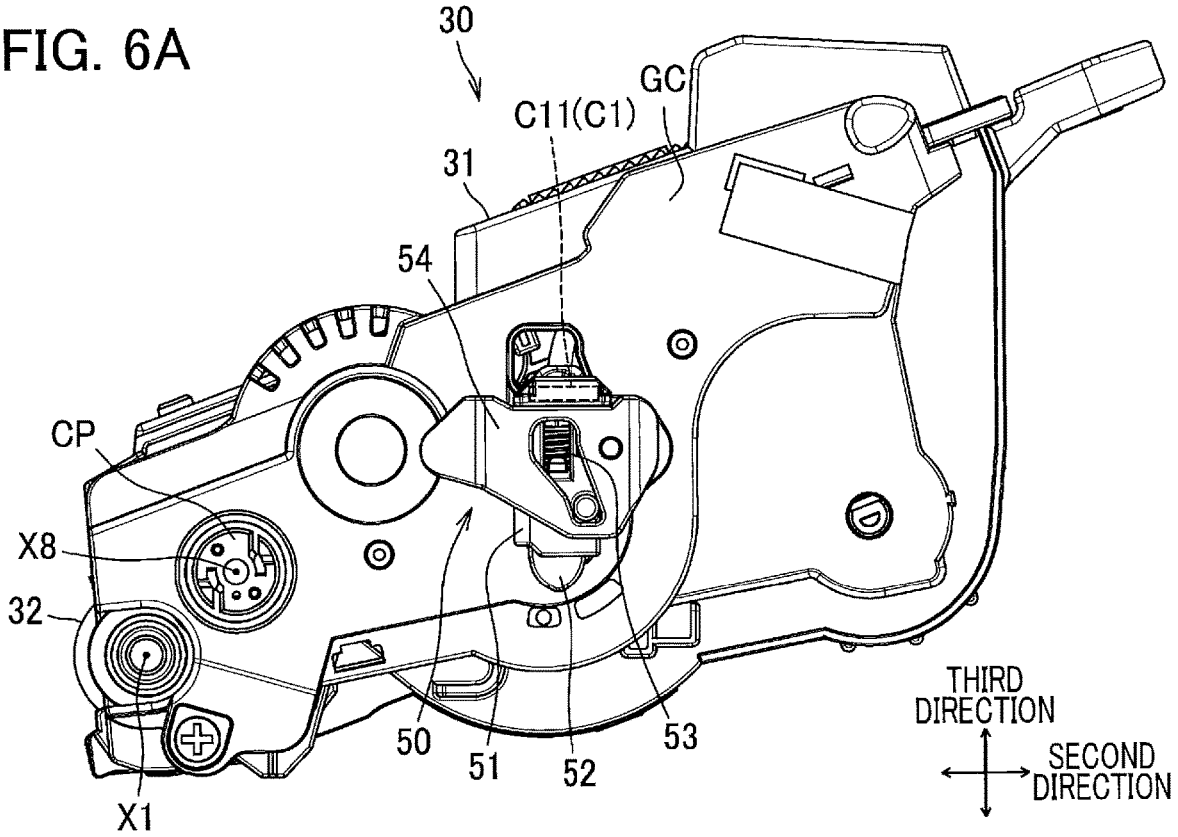
FIG. 6A is a side view of a developing cartridge, and particularly illustrating a state where the process cartridge is not attached to a housing of an image-forming apparatus.
Figure 6B:
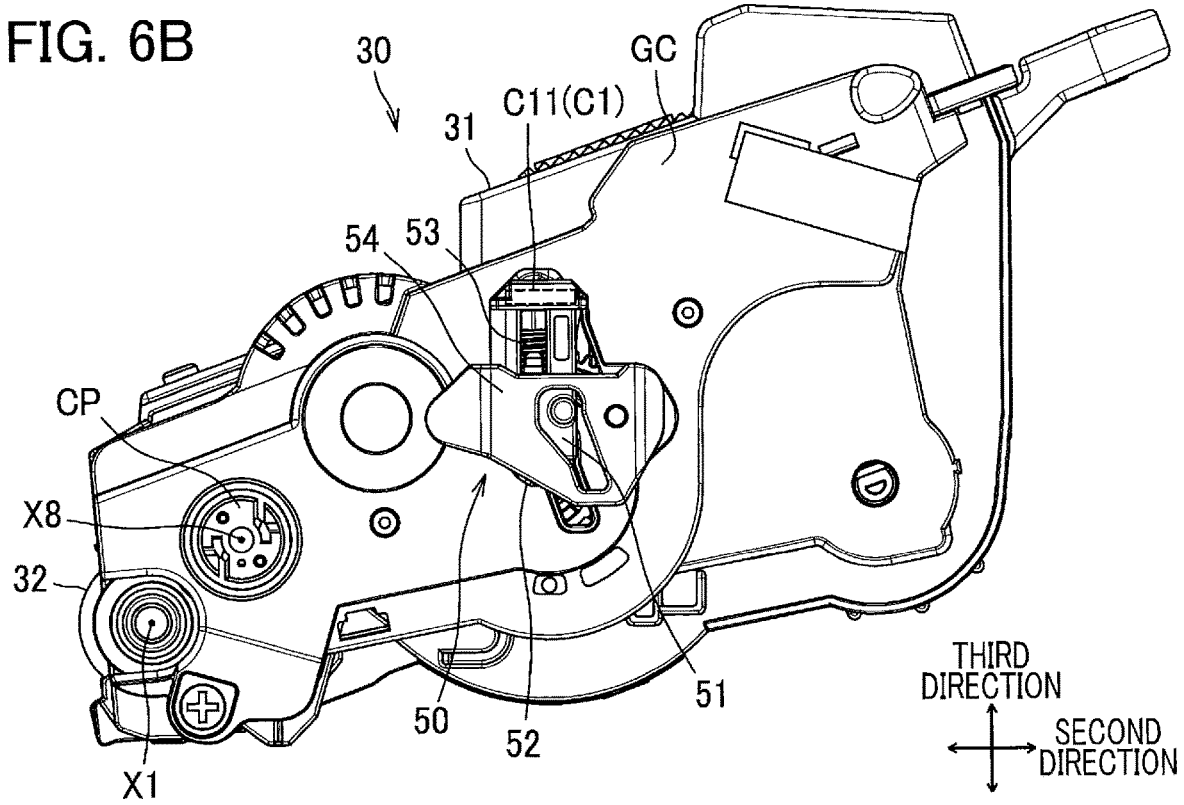
FIG. 6B is a side view of the developing cartridge, and particularly illustrating a state where the process cartridge is attached to the housing.

As illustrated in FIGS. 6A and 6B, the developing coupling CP is rotatable about a coupling axis X8 extending in the first direction. The developing coupling CP is configured to transmit a driving force to the developing roller 32, the supply roller 33, and the agitator 35. As illustrated in FIG. 2, the developing coupling CP is positioned at one end portion 30A of the developing cartridge 30 in the first direction. Specifically, the developing coupling CP is positioned at the first outer surface F1 of the casing 31 in the first direction. The developing coupling CP is configured to be connected to a main coupling (not illustrated) of the housing 10 in the state where the process cartridge 20 is attached to the housing 10.

The developing electrode DE is electrically connected to the developing roller 32 and the supply roller 33. The developing electrode DE is positioned at another end portion 30B of the developing cartridge 30 in the first direction. Specifically, the developing electrode DE is positioned at the second outer surface F2 of the casing 31 in the first direction. The developing electrode DE is configured to contact a main electrode (not illustrated) of the housing 10 in the state where the process cartridge 20 is attached to the housing 10.

The drum cartridge 40 includes the drum frame 41, the photosensitive drum 42, a charger 43, a transfer roller 44, a first cleaning roller 45, a second cleaning roller 47, and a conveyer roller 46.

The photosensitive drum 42 is rotatable about a drum axis X4 extending in the first direction.

The charger 43 is configured to charge the photosensitive drum 42. The charger 43 is a Scorotron charger positioned to be spaced away from the photosensitive drum 42.

The transfer roller 44 is configured to transfer toner on the photosensitive drum 42 to a sheet (not illustrated). The transfer roller 44 is rotatable about a transfer axis X5 extending in the first direction. The transfer roller 44 is in contact with the photosensitive drum 42. The transfer roller 44 faces the photosensitive drum 42 in the third direction. The photosensitive drum 42 is positioned between the charger 43 and the transfer roller 44 in the third direction.

The first cleaning roller 45 is configured to remove toner (waste toner) deposited on the photosensitive drum 42. The first cleaning roller 45 is rotatable about a first cleaning axis X6 extending in the first direction. The first cleaning roller 45 is in contact with the photosensitive drum 42.

The second cleaning roller 47 is configured to remove the toner deposited on the first cleaning roller 45. The second cleaning roller 47 is rotatable about a second cleaning axis X10 extending in the first direction. The second cleaning roller 47 is in contact with the first cleaning roller 45.

The conveyer roller 46 is configured to convey the sheet toward the photosensitive drum 42. The conveyer roller 46 is rotatable about a conveyer axis X7 extending in the first direction.

Figure 3:
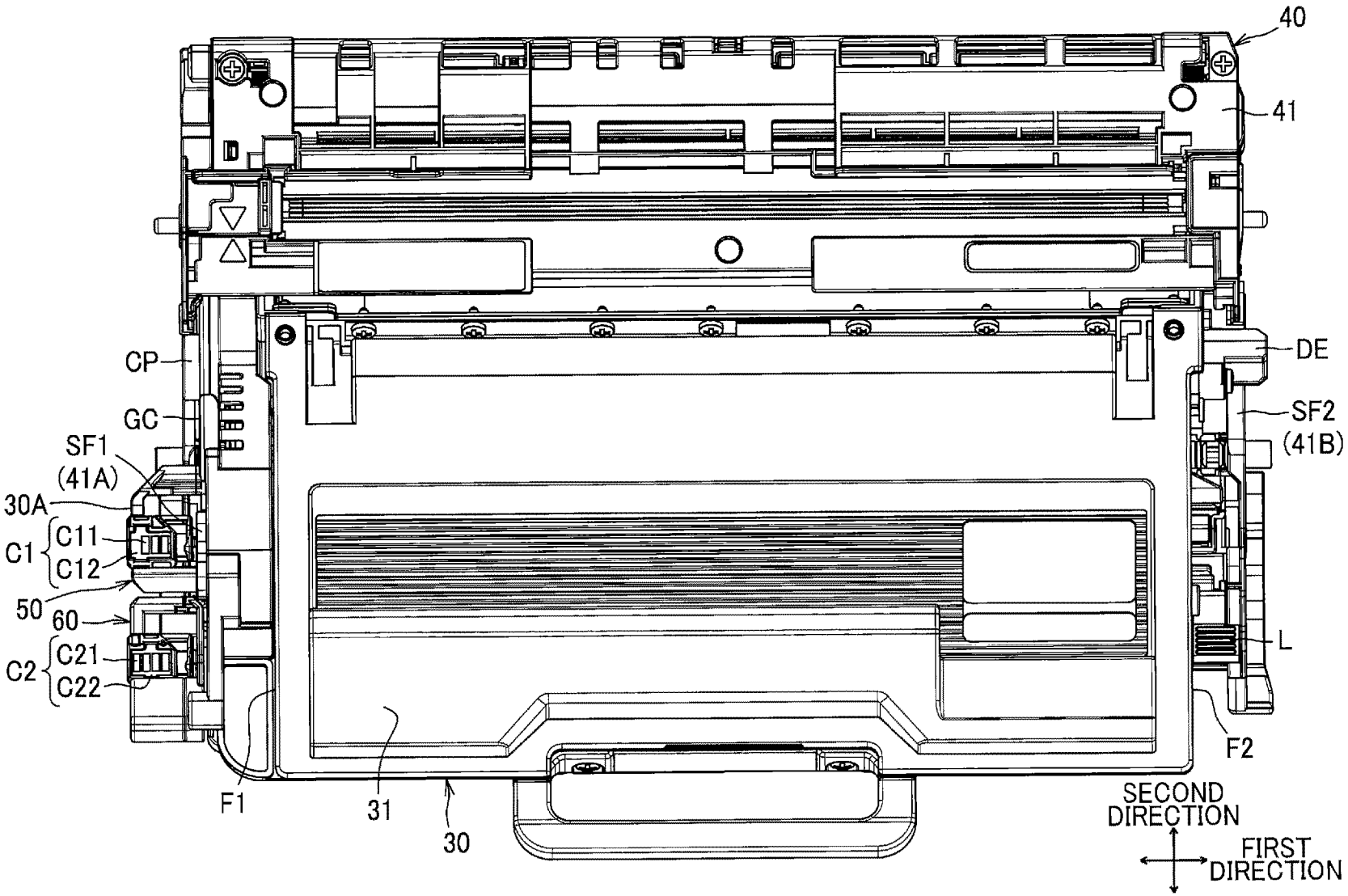
FIG. 3 is a plan view of the process cartridge.

As illustrated in FIGS. 2 and 3, the developing cartridge 30 further includes a gear cover GC, a development-side IC chip C1, and a development-side chip holder 50. The gear cover GC covers gears configured to drive the developing roller 32, and the like. The gear cover GC is positioned at the first outer surface F1 of the casing 31.

The development-side IC chip C1 is configured to store development information about the developing cartridge 30. The development information may be information on a remaining amount of toner in the developing cartridge 30, and a service life of the developing roller 32, for example. The development-side IC chip C1 includes the development-side electrical contact surface C11, and a development-side circuit board C12 including a development-side memory storing the development information. The development-side electrical contact surface C11 is electrically connected to the development-side memory.

The development-side electrical contact surface C11 is positioned at the one end portion 30A of the developing cartridge 30 in the first direction. The development-side electrical contact surface C11 is positioned opposite to the developing roller 32 with respect to the developing coupling CP in the second direction. The development-side electrical contact surface C11 is positioned opposite to the developing roller 32 with respect to the developing electrode DE in the second direction. The development-side electrical contact surface C11 contacts a development-side main contact 13A (described later, see FIG. 9) of the housing 10 in the state where the process cartridge 20 is attached to the housing 10.

The development-side electrical contact surface C11 is positioned apart from the first outer surface F1 of the casing 31 in the first direction. The development-side electrical contact surface C11 is positioned farther away from the first outer surface F1 of the casing 31 than the developing coupling CP is from the first outer surface F1 in the first direction. The development-side electrical contact surface C11 is attached to the gear cover GC through the development-side circuit board C12 and the development-side chip holder 50.

As illustrated in FIGS. 2 and 3, the drum cartridge 40 includes a lock lever L, a drum-side IC chip C2, and a drum-side chip holder 60.

The lock lever L is configured to lock the developing cartridge 30 to the drum frame 41.

The drum-side IC chip C2 is configured to store drum information about the drum cartridge 40. The drum information may be information on a service life of the photosensitive drum 42, for example.

The drum-side IC chip C2 includes a drum-side electrical contact surface C21 and a drum side circuit board C22 including a drum-side memory storing the drum information. The drum-side electrical contact surface C21 is electrically connected to the drum-side memory. The drum-side electrical contact surface C21 is positioned at one end portion 41A of the drum frame 41 in the first direction. The drum-side electrical contact surface C21 contacts a drum-side main contact 13B (described later, see FIG. 9) of the housing 10 in the state where the process cartridge 20 is attached to the housing 10.

The drum frame 41 includes a first side frame SF1 and a second side frame SF2. The second side frame SF2 is positioned to be spaced apart from the first side frame SF1 in the first direction. In a state where the developing cartridge 30 is attached to the drum frame 41, the casing 31 of the developing cartridge 30 is positioned between the first side frame SF1 and the second side frame SF2 in the first direction.

The drum-side electrical contact surface C21 is attached to the first side frame SF1 through the drum side circuit board C22 and the drum-side chip holder 60. In the state where the developing cartridge 30 is attached to the drum frame 41, the development-side electrical contact surface C11 and the drum-side electrical contact surface C21 are positioned opposite to the casing 31 with respect to the first side frame SF1 in the first direction.

The lock lever L is configured to lock the developing cartridge 30 to the drum frame 41. The lock lever L is positioned at another end portion 41B of the drum frame 41 in the first direction. The lock lever L is attached to the second side frame SF2. The development-side electrical contact surface C11 and the drum-side electrical contact surface C21 are positioned opposite to the lock lever L with respect to the casing 31 in the first direction in the state where the developing cartridge 30 is attached to the drum frame 41. Specifically, in the attached state of the developing cartridge 30 to the drum frame 41, the development-side electrical contact surface C11, the developing coupling CP, and the drum-side electrical contact surface C21 are positioned opposite to the lock lever L with respect to the casing 31 in the first direction.

Figure 5A:
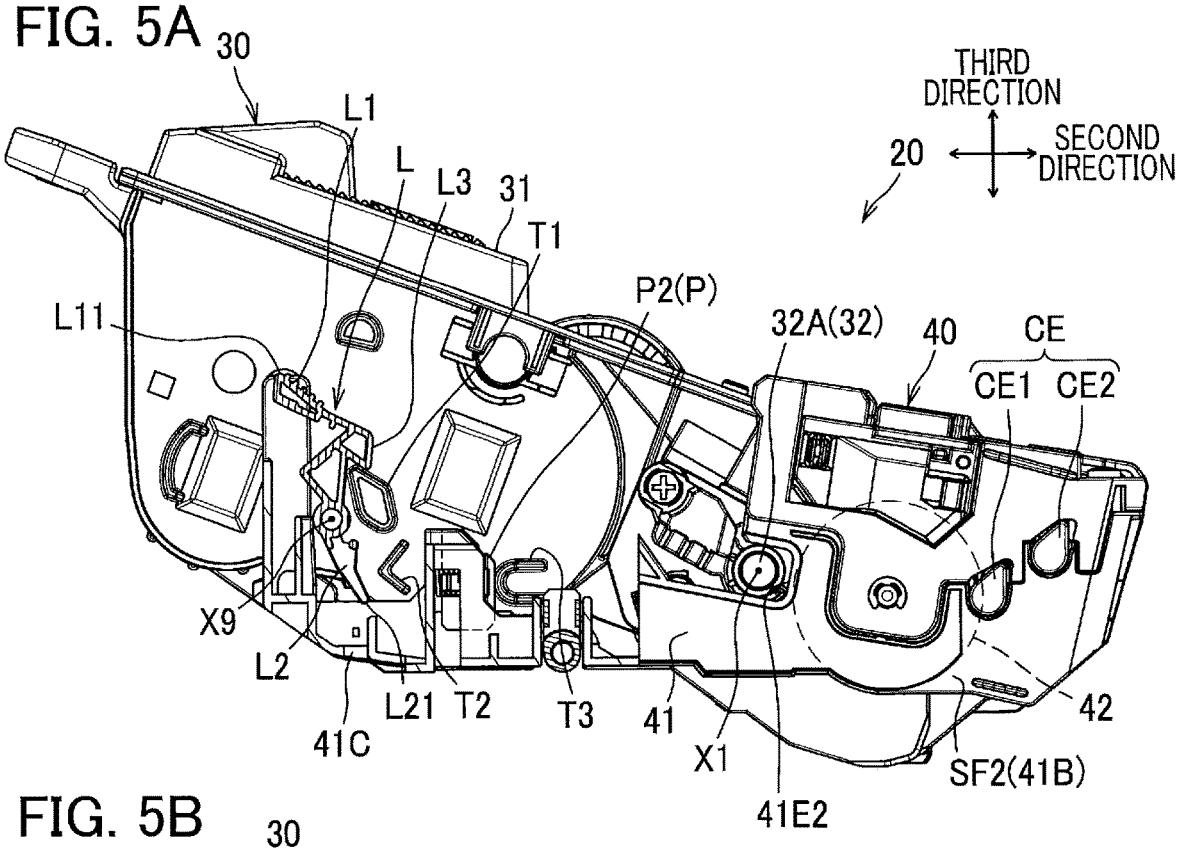
FIG. 5A is a side view of the process cartridge from which a part of a second side frame of a drum frame of the drum cartridge is removed, and particularly illustrating a state where a lock lever is at a locking position.
Figure 5B:
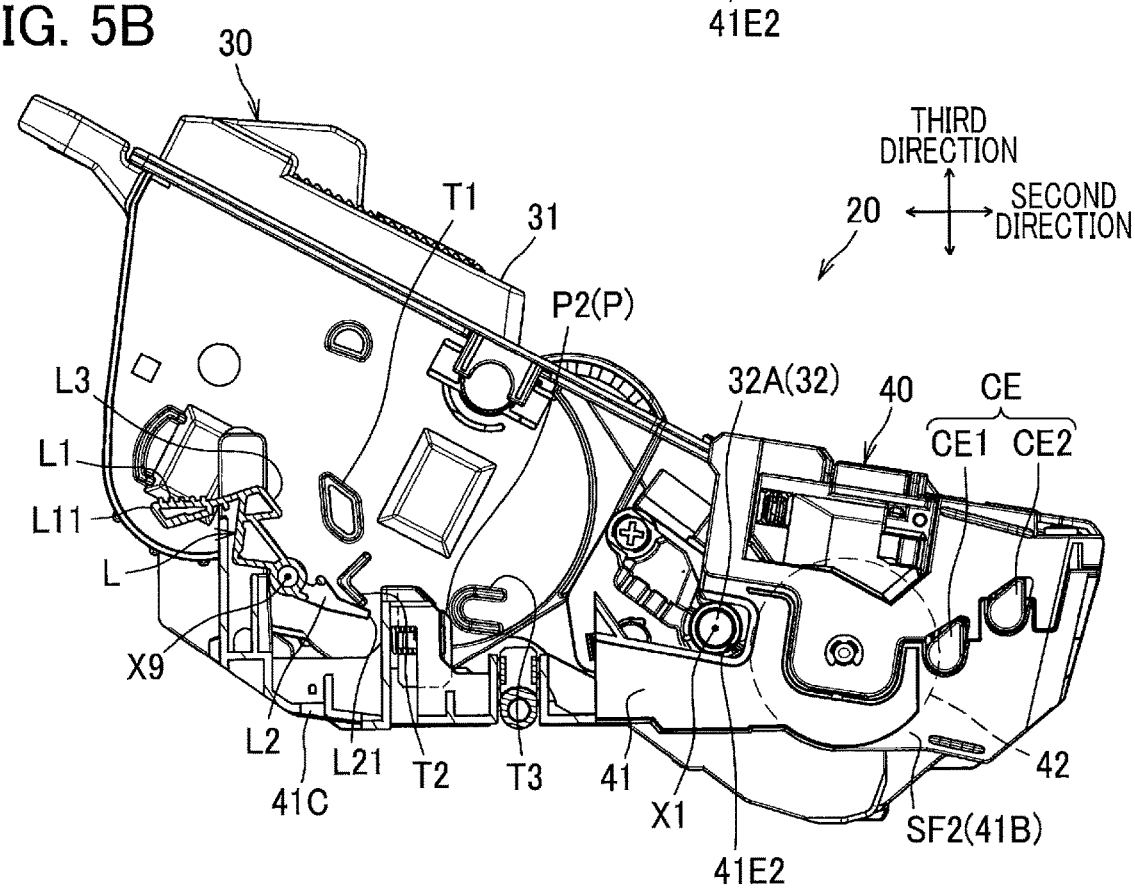
FIG. 5B is a side view of the process cartridge from which the part of the second side frame of the drum frame is removed, and particularly illustrating a state where the lock lever is at a unlock position.

As illustrated in FIGS. 5A and 5B, the drum frame 41 includes a bottom wall 41C. The bottom wall 41C is positioned below the developing cartridge 30 in the attached state of the process cartridge 20 to the housing 10 (see FIG. 1). The lock lever L is configured to push up a part of the developing cartridge 30 in a direction away from the bottom wall 41C of the drum frame 41 in the state where the developing cartridge 30 is attached to the drum frame 41.

The lock lever L is pivotally movable about a lock axis X9 extending in the first direction. The lock lever L is pivotally movable between a locking position illustrated in FIG. 5A and an unlock position illustrated in FIG. 5B. The lock lever L locks the developing cartridge 30 to the drum frame 41 in a state where the lock lever L is at the locking position. The lock lever L unlocks the developing cartridge 30 from the drum frame 41 in a state where the lock lever L is at the unlock position.

The lock lever L includes an operating portion L1, a pressing portion L2, and a locking pawl L3. The operating portion L1 is subject to user's operation. The pressing portion L2 is configured to push up the developing cartridge 30. The locking pawl L3 is configured to lock the developing cartridge 30. The casing 31 of the developing cartridge 30 includes a first protrusion T1, a second protrusion T2, and a third protrusion T3.

The locking pawl L3 contacts the first protrusion T1 in a state where the lock lever L is at the locking position. The pressing portion L2 comes into contact with the second protrusion T2 in a process where the lock lever L is pivoted by the user to the unlock position from the locking position.

The operating portion L1 has a distal end L11 which is an end thereof farthest from the lock axis X9. The pressing portion L2 has a distal end L21 which is an end thereof farthest from the lock axis X9.

The pressing portion L2 is in separation from the second protrusion T2 in the state where the lock lever L is at the locking position. The distal end L21 of the pressing portion L2 is positioned below the lock axis X9 in the state where the process cartridge 20 is attached to the housing 10. Further, the locking pawl L3 and the distal end L11 of the operating portion L1 are positioned above the lock axis X9 in the state where the process cartridge 20 is attached to the housing 10.

The pressing portion L2 contacts the second protrusion T2 in a state where the lock lever L is at the unlock position. The locking pawl L3 is separated away from the first protrusion T1 in the state in the state where the lock lever L is at the unlock position. The distal end L21 of the pressing portion L2 is positioned farther away from the bottom wall 41C in the state where the lock lever L is at the unlock position (FIG. 5B) than when the lock lever is at the locking position (FIG. 5A).

The drum frame 41 has a first recessed portion 41E1 (see FIGS. 7A and 7B) and a second recessed portion 41E2 (see FIGS. 5A and 5B). Specifically, the first side frame SF1 has the first recessed portion 41E1, and the second side frame SF2 has the second recessed portion 41E2. In the state where the developing cartridge 30 is attached to the drum frame 41, one end portion of the developing roller shaft 32A in the first direction of the developing roller 32 is received in the first recessed portion 41E1. Another end portion in the first direction of the developing roller shaft 32A of the developing roller 32 is received in the second recessed portion 41E2 in the state where the developing cartridge 30 is attached to the drum frame 41. The first recessed portion 41E1 is positioned at the one end portion 41A of the drum frame 41. The second recessed portion 41E2 is positioned at the other end portion 41B of the drum frame 41. The first recessed portion 41E1 and the second recessed portion 41E2 are configured to restrain the developing roller shaft 32A from moving in the third direction. With this structure, the developing cartridge 30 is pivotally movable about the developing axis X1 in the third direction in the state where the developing cartridge 30 is attached to the drum frame 41, as illustrated in FIGS. 5A and 5B.

Figure 4:
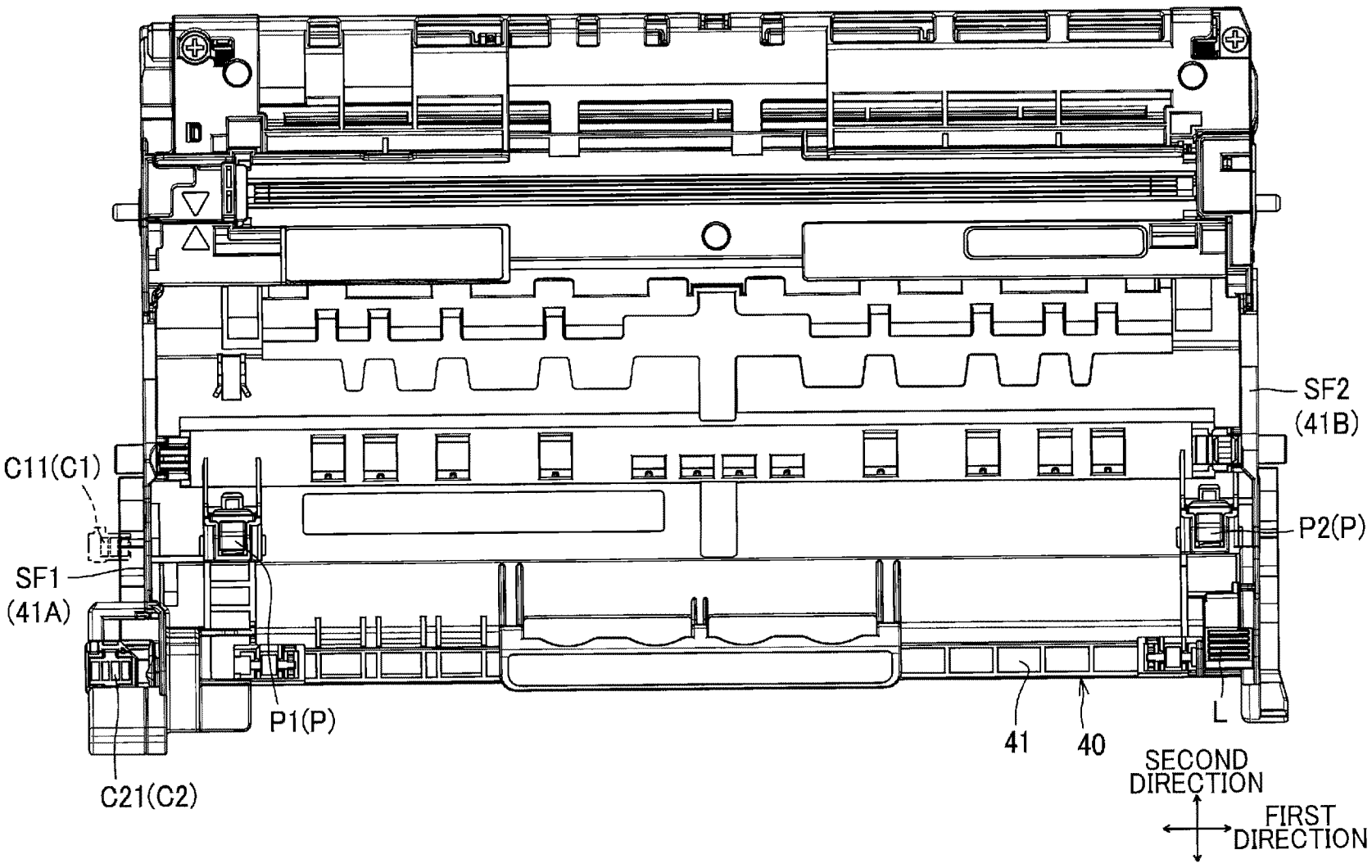
FIG. 4 is a plan view of a drum cartridge.

As illustrated in FIGS. 5A and 5B, the drum cartridge 40 further includes a pressing member P and a cleaning electrode CE. The pressing member P is configured to push the third protrusion T3 to urge the developing roller 32 toward the photosensitive drum 42 in the state where the developing cartridge 30 is attached to the drum frame 41. As illustrated in FIG. 4, the pressing member P includes a first pressing member P1 and a second pressing member P2. The first pressing member P1 is positioned at the one end portion 41A of the drum frame 41 in the first direction. The second pressing member P2 is positioned at the other end portion 41B of the drum frame 41 in the first direction.

Referring to FIG. 4, at least a part of the development-side electrical contact surface C11 is at the same position as a part of the first pressing member P1 and a part of the second pressing member P2 with respect to the second direction. In other words, the development-side electrical contact surface C11 has a portion aligned with each of the first pressing member P1 and the second pressing member P2 in the first direction. At least a part of the drum-side electrical contact surface C21 is at the same position as a part of the lock lever L with respect to the second direction. In other words, the development-side circuit board C12 has a portion aligned with the lock lever L in the first direction.

The cleaning electrode CE is positioned at the other end portion 41B of the drum frame 41 in the first direction. The cleaning electrode CE is positioned at the second side frame SF2. The cleaning electrode CE includes a first cleaning electrode CE1 electrically connected to the first cleaning roller 45, and a second cleaning electrode CE2 electrically connected to the second cleaning roller 47. The first cleaning electrode CE1 and the second cleaning electrode CE2 are made from electrically conductive resin.

As illustrated in FIGS. 6A and 6B, the development-side chip holder 50 is configured to hold the development-side IC chip C1 such that the development-side electrical contact surface C11 is movable relative to the casing 31. The development-side chip holder 50 includes a development-side holder 51, a development-side advance/retract member 52, a development-side spring 53, and a development-side cover 54.

The development-side holder 51 holds the development-side IC chip C1. Further, the development-side holder 51 holds the development-side advance/retract member 52 such that the development-side advance/retract member 52 is movable in the third direction.

The development-side spring 53 is positioned between the development-side holder 51 and the development-side advance/retract member 52. The development-side spring 53 is a coil spring. The development-side spring 53 urges the development-side advance/retract member 52 in a direction away from the development-side IC chip C1.

The development-side cover 54 is attached to the gear cover GC. The development-side holder 51 is positioned between the gear cover GC and the development-side cover 54 attached to the gear cover GC in the first direction. The development-side cover 54 and the gear cover GC hold the development-side holder 51 such that the development-side holder 51 is movable in the third direction and the second direction.

With the development-side chip holder 50 thus constructed, the development-side electrical contact surface C11 is movable between a first position illustrated in FIG. 6A and a second position illustrated in FIG. 6B. The development-side electrical contact surface C11 is at the first position (FIG. 6A) prior to attachment of the process cartridge 20 to the housing 10. The development-side holder 51 is held by the development-side cover 54 and the gear cover GC in a state where the development-side electrical contact surface C11 is at the first position.

The development-side electrical contact surface C11 is at the second position (FIG. 6B) in the attached state of the process cartridge 20 to the housing 10. As illustrated in FIG. 6B, the development-side electrical contact surface C11 is positioned farther away from the developing axis X1 in the third direction in a state where the development-side electrical contact surface C11 is at the second position than in the state where the development-side electrical contact surface C11 is at the first position. Further, the development-side electrical contact surface C11 is positioned closer to the developing axis X1 in the second direction in the state where the development-side electrical contact surface C11 is at the second position than in the state where the development-side electrical contact surface C11 is at the first position.

Figure 7A:
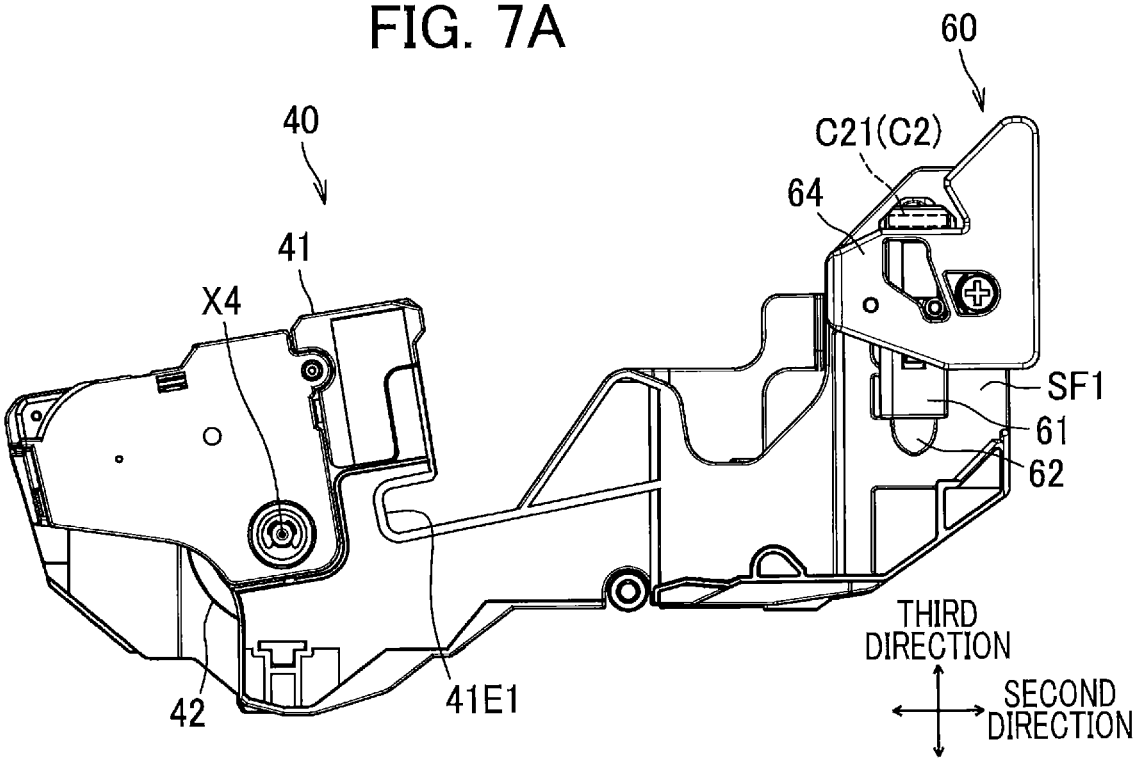
FIG. 7A is a side view of the drum cartridge, and particularly illustrating a state where the process cartridge is not attached to the housing.
Figure 7B:
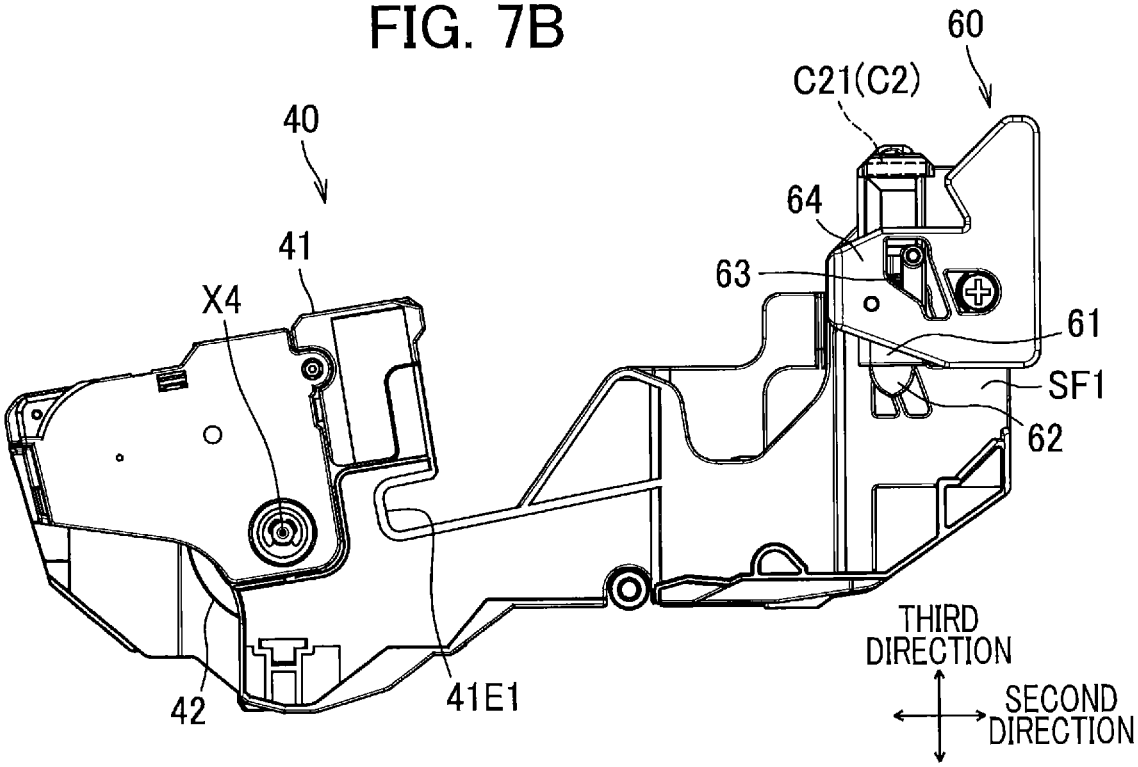
FIG. 7B is a side view of the drum cartridge, and particularly illustrating a state where the process cartridge is attached to the housing.

As illustrated in FIGS. 7A and 7B, the drum-side chip holder 60 is configured to hold the drum-side IC chip C2 such that the drum-side electrical contact surface C21 is movable relative to the drum frame 41. The drum-side chip holder 60 includes a drum-side holder 61, a drum-side advance/retract member 62, a drum-side spring 63, and a drum-side cover 64.

The drum-side holder 61 holds the drum-side IC chip C2. Further, the drum-side holder 61 holds the drum-side advance/retract member 62 such that the drum-side advance/retract member 62 is movable in the third direction.

The drum-side spring 63 is positioned between the drum-side holder 61 and the drum-side advance/retract member 62. The drum-side spring 63 is a coil spring. The drum-side spring 63 urges the drum-side advance/retract member 62 in a direction away from the drum-side IC chip C2.

The drum-side cover 64 is attached to the first side frame SF1. The drum-side holder 61 is positioned between the first side frame SF1 and the drum-side cover 64 attached to the first side frame SF1 in the first direction. The drum-side cover 64 and the first side frame SF1 hold the drum-side holder 61 such that the drum-side holder 61 is movable in the third direction and the second direction.

With the drum-side chip holder 60 thus constructed, the drum-side electrical contact surface C21 is movable between a third position illustrated in FIG. 7A and a fourth position illustrated in FIG. 7B.

The drum-side electrical contact surface C21 is at the third position (FIG. 7A) prior to attachment of the process cartridge 20 to the housing 10. The drum-side holder 61 is held by the drum-side cover 64 and the first side frame SF1 in a state where the drum-side electrical contact surface C21 is at the third position.

The drum-side electrical contact surface C21 is at the fourth position in the state where the process cartridge 20 is attached to the housing 10. As illustrated in FIG. 7B, the drum-side electrical contact surface C21 is positioned farther away from the drum axis X4 in the third direction in a state where the drum-side electrical contact surface C21 is at the fourth position than in the state where the drum-side electrical contact surface C21 is at the third position. Further, the drum-side electrical contact surface C21 is positioned closer to the drum axis X4 in the second direction in the state where the drum-side electrical contact surface C21 is at the fourth position than in the state where the drum-side electrical contact surface C21 is at the third position.

Figure 9:
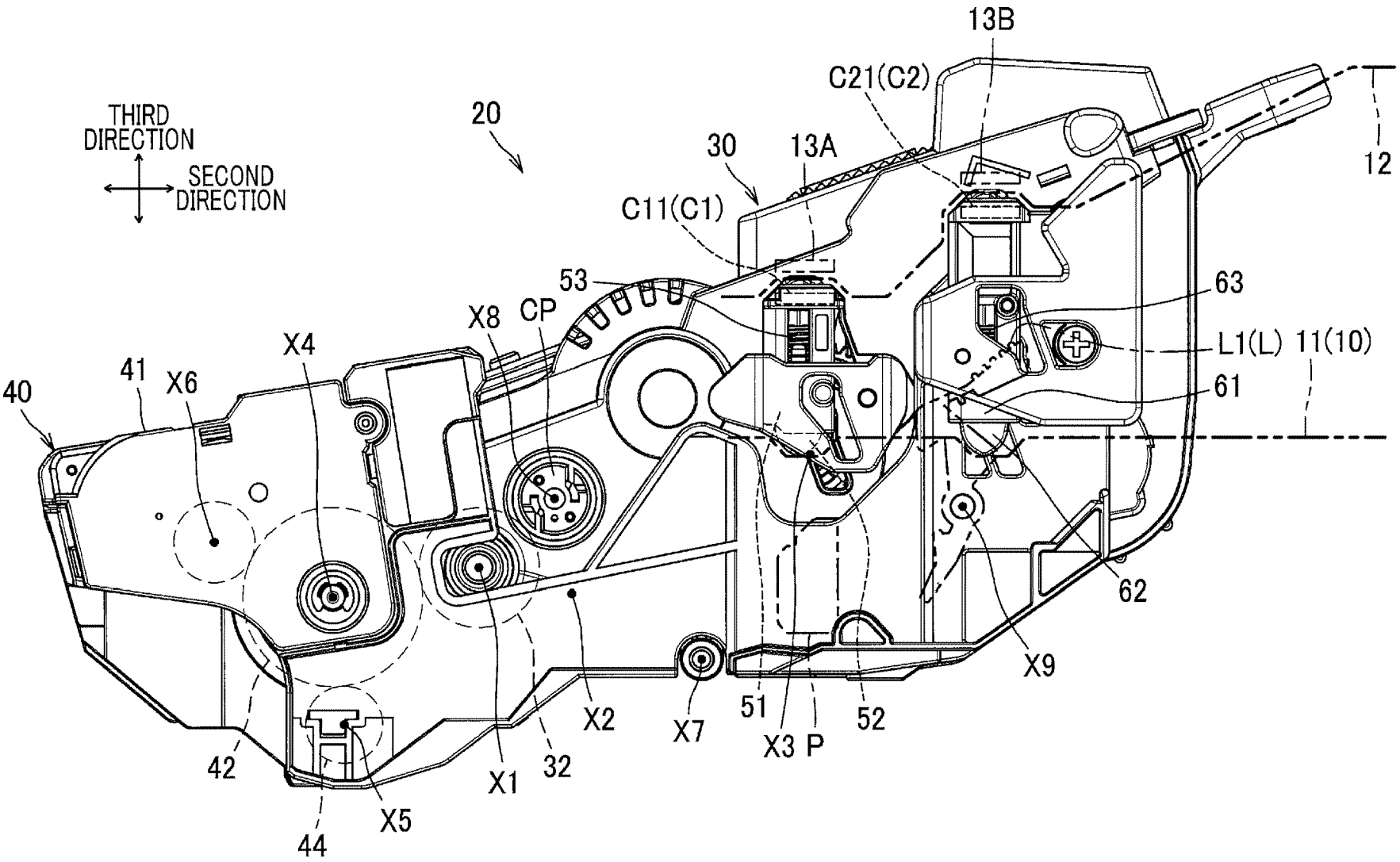
FIG. 9 is a side view of the process cartridge, and particularly illustrating a state where the process cartridge is attached to the housing.

As illustrated in FIG. 9, the housing 10 includes a first guide 11, a second guide 12, the development-side main contact 13A, and the drum-side main contact 13B. The first guide 11 is configured to guide the development-side advance/retract member 52 and the drum-side advance/retract member 62 through contact with respective lower ends of the development-side advance/retract member 52 and the drum-side advance/retract member 62. The second guide 12 is configured to guide the development-side holder 51 and the drum-side holder 61 through contact with respective upper ends of the development-side holder 51 and the drum-side holder 61.

The development-side main contact 13A is configured to contact the development-side electrical contact surface C11. The development-side main contact 13A is configured to electrically connect the development-side IC chip C1 to a controller (not illustrated). Incidentally, in FIG. 9, the development-side main contact 13A and the development-side IC chip C1 are illustrated as being separated from each other for the sake of simplicity.

The drum-side main contact 13B is configured to contact the drum-side electrical contact surface C21. The drum-side main contact 13B is configured to electrically connect the drum-side IC chip C2 to the controller (not illustrated). Incidentally, in FIG. 9, the drum-side main contact 13B and the drum-side IC chip C2 are depicted as being separated from each other for the sake of simplicity.

The development-side holder 51 is held by the first guide 11 of the housing 10 through the development-side advance/retract member 52 and the development-side spring 53 in a state where the development-side electrical contact surface C11 is at the second position. The development-side IC chip C1 is urged toward the development-side main contact 13A by an urging force of the development-side spring 53 in the state where the development-side electrical contact surface C11 is at the second position. The development-side electrical contact surface C11 is in contact with the development-side main contact 13A in the state where the development-side electrical contact surface C11 is at the second position.

The drum-side holder 61 is held by the first guide 11 of the housing 10 through the drum-side advance/retract member 62 and the drum-side spring 63 in a state where the drum-side electrical contact surface C21 is at the fourth position. The drum-side IC chip C2 is urged toward the drum-side main contact 13B by an urging force of the drum-side spring 63 in the state where the drum-side electrical contact surface C21 is at the fourth position. The drum-side electrical contact surface C21 is in contact with the drum-side main contact 13B in the state where the drum-side electrical contact surface C21 is at the fourth position.

Figure 8:
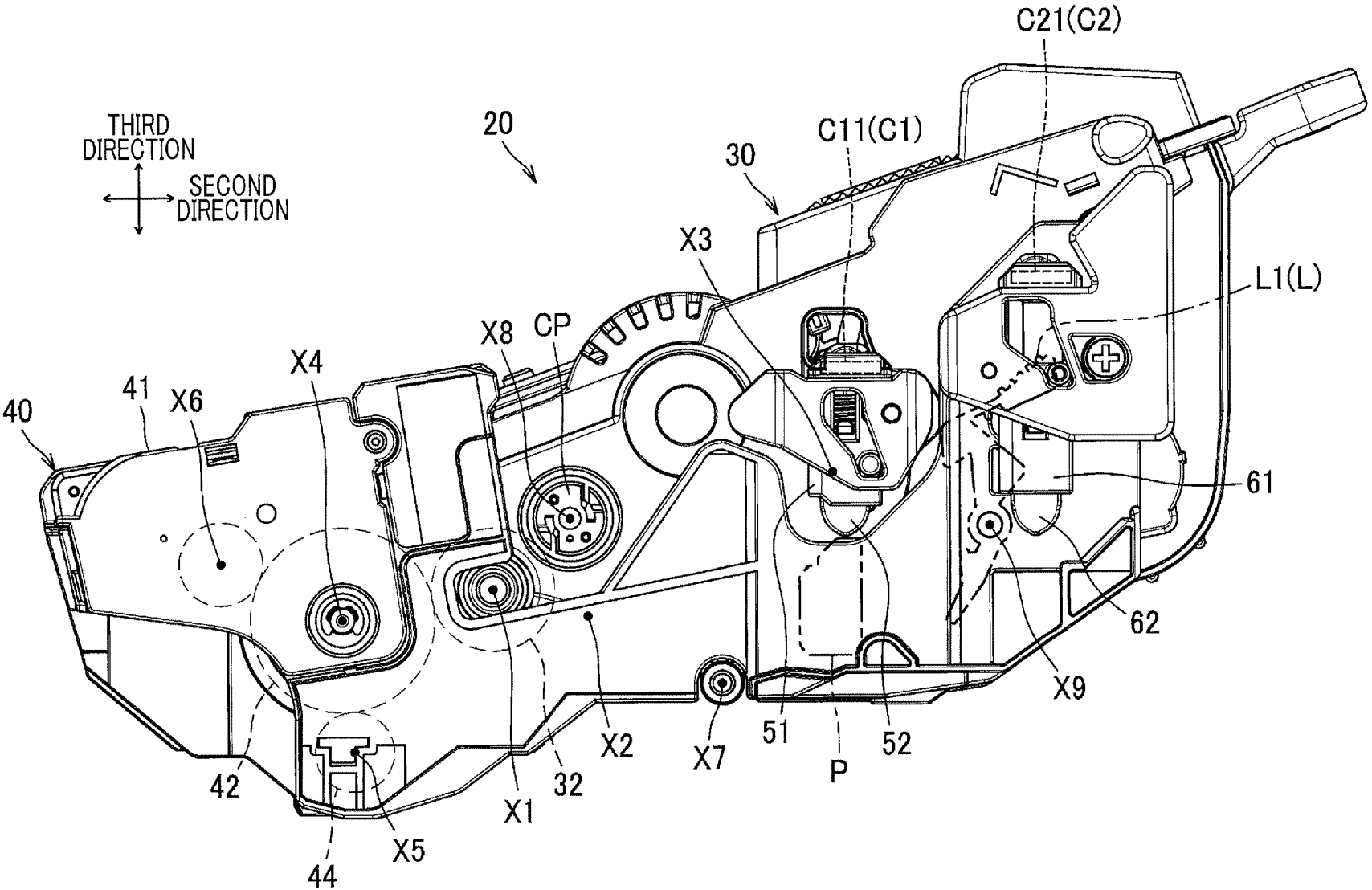
FIG. 8 is a side view of the process cartridge, and particularly illustrating a state where the process cartridge is not attached to the housing.

As illustrated in FIG. 8, the development-side electrical contact surface C11 is positioned between the developing roller 32 and the drum-side electrical contact surface C21 in the second direction in the state where the developing cartridge 30 is attached to the drum frame 41. The development-side electrical contact surface C11 is positioned between the drum-side electrical contact surface C21 and the transfer roller 44 in the third direction in the state where the developing cartridge 30 is attached to the drum frame 41.

The operating portion L1 of the lock lever L is positioned between the drum-side electrical contact surface C21 and the transfer roller 44 in the third direction. The development-side electrical contact surface C11 is positioned between the developing roller 32 and the operating portion L1 in the second direction in the state where the developing cartridge 30 is attached to the drum frame 41. The pressing member P is positioned between the drum-side electrical contact surface C21 and the transfer roller 44 in the third direction.

Here, FIG. 8 illustrates a state of the process cartridge 20 that is not attached to the housing 10. FIG. 9 illustrates a state of the process cartridge 20 that is attached to the housing 10. The positional relationship described above is unchanged and established, regardless of whether the process cartridge 20 is attached to the housing 10 or not.

As illustrated in FIGS. 8 and 9, at least a part of the operating portion L1 is positioned between the development-side electrical contact surface C11 and the transfer roller 44 in the third direction in the state where the developing cartridge 30 is attached to the drum frame 41. Specifically, as illustrated in FIG. 8, at least a part of the operating portion L1 is positioned between the development-side electrical contact surface C11 and the transfer roller 44 in the third direction in a state where the process cartridge 20 is detached from the housing 10. Further, as illustrated in FIG. 9, an entirety of the operating portion L1 is positioned between the development-side electrical contact surface C11 and the transfer roller 44 in the third direction in the state where the process cartridge 20 is attached to the housing 10.

According to the structure of the embodiment described above, the following technical advantages can be obtained.

In the depicted embodiment, the development-side electrical contact surface C11 and the drum-side electrical contact surface C21 are positioned opposite to the lock lever L with respect to the casing 31 of the developing cartridge 30 in the first direction. This configuration can suppress a user's hand from touching the development-side electrical contact surface C11 or with the drum-side electrical contact surface C21 when the user operates the lock lever L. Accordingly, contamination of the development-side electrical contact surface C11 or the drum-side electrical contact surface C21 by the user's hand is less likely to occur.

Various modifications are conceivable.

For example, according to the above-described embodiment, the electrical contact surface and the memory are integrally provided on the single circuit board (as in the development-side IC chip C1 and drum-side IC chip C2). However, the electrical contact surface and the memory may be provided at separate members. In the latter case, the electrical contact surface may be electrically connected to the memory through a harness.

For removing the toner on the photosensitive drum, a cleaning blade in contact with the photosensitive drum 42 may be available as a cleaning member, instead of the first cleaning roller 45.

For charging the photosensitive drum 42, a charging roller in contact with the photosensitive drum 42 may be available as a charger, instead of the charger 43 of a Scorotron type.

The described embodiment, modifications and variations may be combined as appropriate.

While the description has been made in detail with reference to the embodiments, it would be apparent to those skilled in the art that many modifications and variations may be made thereto.

<Remarks>

The process cartridge 20 is an example of a process cartridge. The developing cartridge 30 is an example of a developing cartridge. The drum cartridge 40 is an example of a drum cartridge. The casing 31 is an example of a casing. The developing roller 32 is an example of a developing roller. The development-side IC chip C1 is an example of a development-side IC chip. The development-side electrical contact surface C11 is an example of a development-side electrical contact surface. The drum frame 41 is an example of a drum frame. The photosensitive drum 42 is an example of a photosensitive drum. The drum-side IC chip C2 is an example of a drum-side IC chip. The drum-side electrical contact surface C21 is an example of a drum-side electrical contact surface. The lock lever L is an example of a lock lever. The operating portion L1 is an example of an operating portion of the lock lever. The first outer surface F1 of the casing 31 is an example of an outer surface of the casing in the first direction. The first side frame SF1 is an example of a first side frame of the drum frame. The second side frame SF2 is an example of a second side frame of the drum frame. The transfer roller 44 is an example of a transfer roller. The pressing member P is an example of a pressing member. The first pressing member P1 is an example of a first pressing member. The second pressing member P2 is an example of a second pressing member. The developing coupling CP is an example of a developing coupling.

What is claimed is:

1. A process cartridge comprising:

a developing cartridge including:

a casing configured to accommodate therein toner;

a developing roller rotatable about a developing axis extending in a first direction; and a development-side IC chip having a development-side electrical contact surface; and a drum cartridge including:

a drum frame to which the developing cartridge is detachably attachable;

a photosensitive drum rotatable about a drum axis extending in the first direction;

a drum-side IC chip having a drum-side electrical contact surface; and a lock lever configured to lock the developing cartridge to the drum frame, wherein the development-side electrical contact surface and the drum-side electrical contact surface are positioned opposite to the lock lever with respect to the casing in the first direction in a state where the developing cartridge is attached to the drum frame.

2. The process cartridge according to claim 1, wherein the development-side electrical contact surface is positioned at one end portion of the developing cartridge in the first direction, wherein the drum-side electrical contact surface is positioned at one end portion of the drum frame in the first direction, and wherein the lock lever is positioned at another end portion of the drum frame in the first direction.

3. The process cartridge according to claim 1, wherein the development-side electrical contact surface is movable relative to the casing.

4. The process cartridge according to claim 1, wherein the drum-side electrical contact surface is movable relative to the drum frame.

5. The process cartridge according to claim 1, wherein the casing has an outer surface at one end portion of the developing cartridge in the first direction, and wherein the development-side electrical contact surface is positioned away from the outer surface in the first direction.

6. The process cartridge according to claim 1, wherein the casing has an outer surface at one end portion of the developing cartridge in the first direction, and wherein the developing cartridge further includes a gear cover positioned at the outer surface, the development-side electrical contact surface being attached to the gear cover.

7. The process cartridge according to claim 1, wherein the drum frame includes a first side frame and a second side frame spaced away from the first side frame in the first direction, wherein the casing is positioned between the first side frame and the second side frame in the first direction in the state where the developing cartridge is attached to the drum frame, and wherein the development-side electrical contact surface is positioned opposite to the casing with respect to the first side frame in the first direction in the state where the developing cartridge is attached to the drum frame.

8. The process cartridge according to claim 7, wherein the drum-side electrical contact surface is attached to the first side frame.

9. The process cartridge according to claim 8, wherein the lock lever is attached to the second side frame.

10. The process cartridge according to claim 7, wherein the drum-side electrical contact surface is positioned opposite to the casing with respect to the first side frame in the first direction in the state where the developing cartridge is attached to the drum frame.

11. The process cartridge according to claim 1, wherein the lock lever is configured to push up a part of the developing cartridge in a direction away from the drum frame.

12. The process cartridge according to claim 1, wherein, in the state where the developing cartridge is attached to the drum frame, the development-side electrical contact surface is positioned between the developing roller and the drum-side electrical contact surface in a second direction crossing the first direction.

13. The process cartridge according to claim 12, wherein the second direction is perpendicular to the first direction.

14. The process cartridge according to claim 12, wherein the drum cartridge further includes a transfer roller in contact with the photosensitive drum and facing the photosensitive drum in a third direction crossing the first direction and the second direction.

15. The process cartridge according to claim 14, wherein the lock lever includes an operating portion configured to be operated by a user, the operating portion being positioned between the drum-side electrical contact surface and the transfer roller in the third direction.

16. The process cartridge according to claim 15, wherein at least a part of the operating portion is positioned between the development-side electrical contact surface and the transfer roller in the third direction.

17. The process cartridge according to claim 14, wherein the drum cartridge further includes a pressing member configured to press a part of the casing to urge the developing roller toward the photosensitive drum in the state where the developing cartridge is attached to the drum frame, the pressing member being positioned between the drum-side electrical contact surface and the transfer roller in the third direction.

18. The process cartridge according to claim 17, wherein the pressing member includes:

a first pressing member positioned at one end portion of the drum frame in the first direction; and a second pressing member positioned at another end portion of the drum frame in the first direction.

19. The process cartridge according to claim 14, wherein the development-side electrical contact surface is positioned between the drum-side electrical contact surface and the transfer roller in the third direction in the state where the developing cartridge is attached to the drum frame.

20. The process cartridge according to claim 1, wherein the developing cartridge further includes a developing coupling rotatable about a coupling axis extending in the first direction, and wherein the developing coupling is positioned opposite to the lock lever with respect to the casing of the developing cartridge in the first direction in the state where the developing cartridge is attached to the drum frame.

* * * * *